US010480180B2

(12) United States Patent
Rios

(10) Patent No.: US 10,480,180 B2
(45) Date of Patent: Nov. 19, 2019

(54) DIMENSIONAL LUMBER WRAP

(71) Applicant: Aureliano Juan Rios, Dunkirk, NY (US)

(72) Inventor: Aureliano Juan Rios, Dunkirk, NY (US)

( * ) Notice: Subject to any disclaimer, the term of this patent is extended or adjusted under 35 U.S.C. 154(b) by 84 days.

(21) Appl. No.: 15/727,076

(22) Filed: Oct. 6, 2017

(65) Prior Publication Data

US 2018/0073243 A1 Mar. 15, 2018

Related U.S. Application Data

(63) Continuation-in-part of application No. 14/756,606, filed on Sep. 24, 2015, now abandoned.

(51) Int. Cl.

| | |
|---|---|
| ***E04B 1/62*** | (2006.01) |
| ***E04B 1/72*** | (2006.01) |
| ***E04B 1/70*** | (2006.01) |
| ***E04C 2/20*** | (2006.01) |
| ***E04F 13/073*** | (2006.01) |
| ***E04C 2/52*** | (2006.01) |

(52) U.S. Cl.

CPC ..... *E04B 1/62* (2013.01); *E04B 1/70* (2013.01); *E04B 1/72* (2013.01); *E04C 2/20* (2013.01); *E04C 2/52* (2013.01); *E04F 13/073* (2013.01)

(58) Field of Classification Search

CPC ..... E04F 15/02183; E04F 15/02044; E04F 15/10; E04F 13/073; E04F 13/0736; E04B 1/72; E04B 1/62; E04B 1/70; E04C 2/52; E04H 9/16

USPC ..... 52/309.1, 514

See application file for complete search history.

(56) References Cited

U.S. PATENT DOCUMENTS

| | | | | |
|---|---|---|---|---|
| 4,019,301 | A * | 4/1977 | Fox | E02D 5/60 405/216 |
| 4,474,842 | A | 10/1984 | Ankerman | |
| D300,566 | S * | 4/1989 | Fein | D25/119 |
| 6,363,677 | B1 * | 4/2002 | Chen | E04F 15/02 52/384 |
| 7,914,855 | B2 * | 3/2011 | Shortland | D06N 3/06 427/202 |
| 7,997,044 | B2 * | 8/2011 | Green | A47B 96/202 220/6 |
| 8,074,424 | B2 * | 12/2011 | Waters | E04F 13/0733 52/287.1 |
| 8,820,033 | B2 * | 9/2014 | Yang | E04C 3/17 29/428 |

(Continued)

*Primary Examiner* — William V Gilbert

(74) *Attorney, Agent, or Firm* — Vincent G. LoTempio; Kloss, Stenger & LoTempio; David T. Stephenson

(57) ABSTRACT

A building unit encasement device encapsulates at least one unit of building material that is known in the art for building structures, so as to protect wooden or steel units from moisture and insects that can destroy the building unit. The device provides an elongated, rectangular container that encapsulates lumber. The device provides four walls that form a cavity to receive a wood or steel building unit. At least two of the walls form a hinged relationship that allows air to flow into the cavity for circulation and drying the building unit. A male-female connector is comprised of a cylindrical protrusion having ribs that interact with lips on a receptacle to prevent high winds from removing the cylindrical protrusion from the receptacle.

17 Claims, 5 Drawing Sheets

(56) References Cited

U.S. PATENT DOCUMENTS

| | | | | |
|---|---|---|---|---|
| 9,010,069 | B2 * | 4/2015 | Bernard | E04H 12/2292 52/844 |
| 9,809,994 | B1 * | 11/2017 | Neff | E04H 17/1426 |
| 2007/0138452 | A1 * | 6/2007 | Donabedian | E04H 12/2292 256/1 |
| 2018/0163406 | A1 * | 6/2018 | Omli | F16B 15/08 |

* cited by examiner

DIMENSIONAL LUMBER WRAP

RELATED APPLICATIONS

This application is a continuation-in-part from application Ser. No. 14/756,606 filed on Sep. 24, 2015.

FIELD

The present disclosure relates to protecting building units such as wood or steel framing material that is known in the art for building structures, and more particularly to a building unit encasement device that is a vinyl wood wrap that can open and close around a building unit to protect wooden or steel units from moisture and insects that can destroy the building unit.

BACKGROUND

This section provides background information related to the present disclosure of a building unit encasement device and is not necessarily prior art. In construction there have always been several problems with long-term preservation of building units such as two by fours made of steel and wood. The primary problems with long-term preservation are inclement weather and insects that nest and feed on the wood. Rain and moisture rots wood and rust steel. Change in temperature from extreme heat to cold can rot and warp wood and steel. Units are particularly susceptible to insects such as termites, carpenter ants and carpenter bees.

While certain technology exists for encapsulating a building material none of the existing technology includes a means for easy closing of the wrap that also increases the ability of the wrap to resist wind and undesirable forces that may detach the sleeve, or building unit encasement device, while in use.

SUMMARY

This section provides a general summary of this disclosure building unit encasement device, and is not a comprehensive disclosure of its full scope or all its features.

A building unit encasement device, constructed in accordance with the present disclosure provides an elongated, rectangular container that encapsulates lumber, such as 2×4 strips of wood, and steel beams. The building unit encasement device has four walls that form a cavity to receive a wood or steel building unit. At least two of the walls form a hinged relationship that allows air to flow into the cavity for circulation and drying the building unit. The container is fabricated form vinyl, so as to enable facilitated cutting of any of the walls at an angle. In this manner, various widths of building units can be fit in the building unit encasement device. Further, a silicon composition on the vinyl inhibits damage from insects and moisture.

An attachment mechanism consists of a cylindrical protrusion, or male end, at a second, or hinge, edge of the building unit encasement device. The male end has a series of longitudinal ridges that fit in a depressed cavity at the first end of the building unit encasement device. The male and female ends are snapped together and the ridges of the male end to provide support against forces such as wind that may act to detach the two ends of the building unit encasement device during use.

DETAILED DESCRIPTION OF INVENTION

Figure 2:
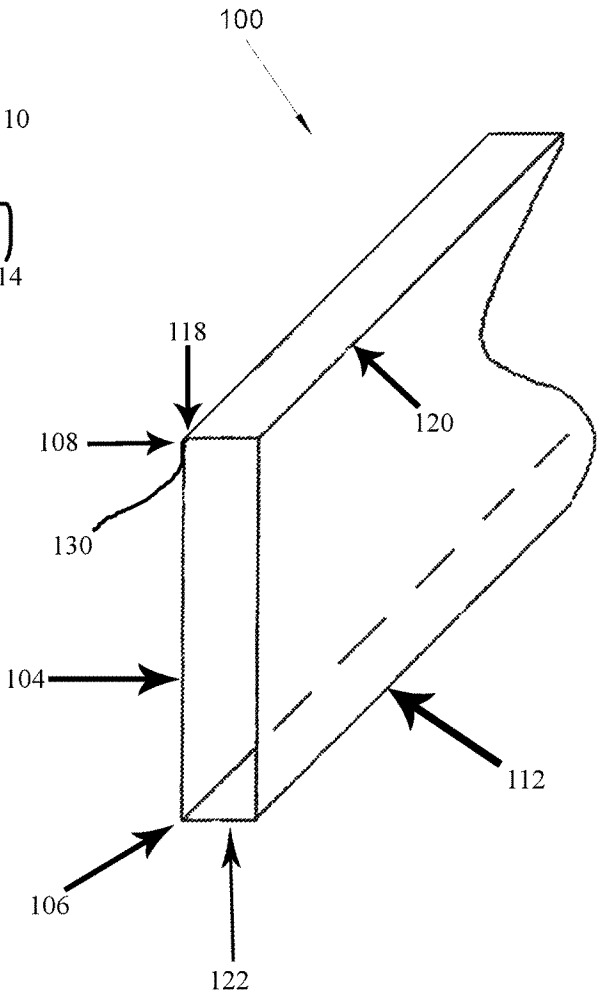
FIG. 2 illustrates a partial sectioned right side view of the building unit encasement device, in accordance with an embodiment of the present invention.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

Averting now to the drawings a building unit encasement device 100 is referenced in FIGS. 1-6. The building unit encasement device 100 encapsulates at least one unit of building material that is known in the art for building structures, so as to protect wooden or steel units from moisture and insects that can destroy the building unit.

Figure 1:
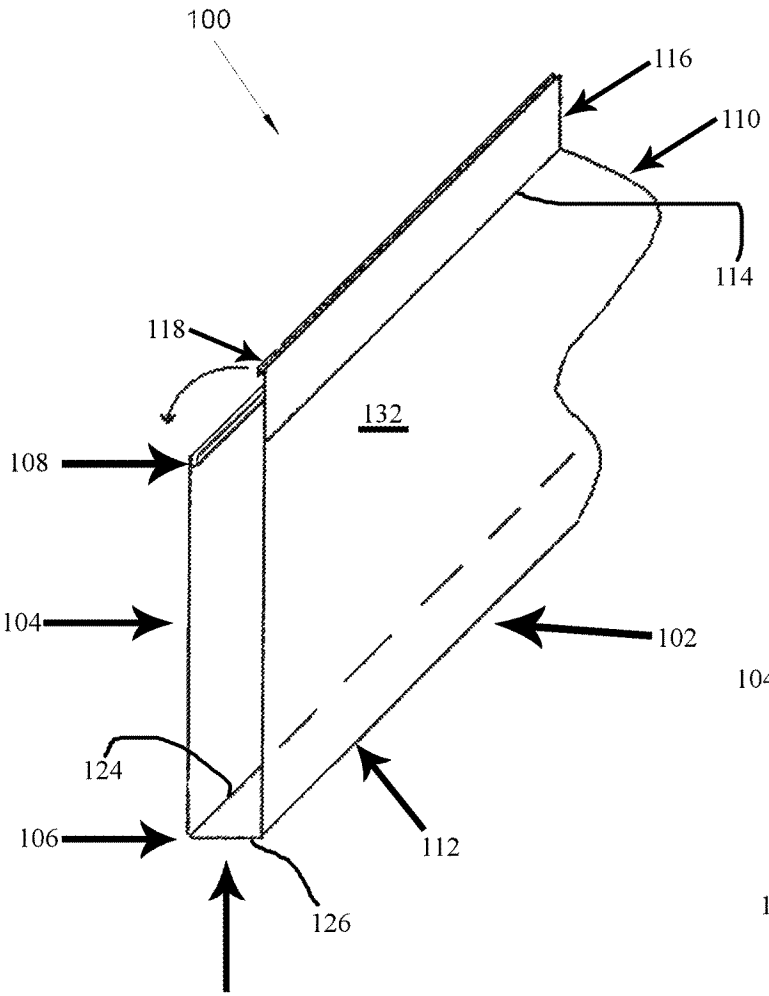
FIG. 1 illustrates a partial sectioned left side view of an exemplary building unit encasement device, in accordance with an embodiment of the present invention.

As shown in FIG. 1, building unit encasement device 100 provides an elongated, rectangular container 102 that encapsulates lumber, such as 2×4 strips of wood and steel beams. The device 100 provides four walls 104, 110, 116, 122 that form a cavity to receive a wood or steel building unit. At least two of the walls 104, 116 form a hinged relationship that allows air to flow into the cavity for circulation and drying the building unit. The container 102 is fabricated from vinyl, so as to enable facilitated cutting of any of the walls 104, 110, 116, 122 at an angle. In this manner, various widths of building units can be fit in the container 102. Further, a silicon composition 132 on the vinyl inhibits damage from insects and moisture. The four walls may unfold into a sheet and have a male and female connector at the opposite ends. With obvious modification, either end could, in certain embodiments, incorporate the male or female connector, such that the male and female ends, as would be known to one of ordinary skill in the art, could be reversible and interchangeable.

As FIG. 2 references, the building unit encasement device 100 comprises an elongated container 102 that is adapted to receive and store wood or steel building unit. The building unit may include a 2×4 strip of lumber, or other elongated building material known in the art. The building unit encasement device 100 is fabricated from a vinyl material that is configured to be easily cut.

Figure 3:
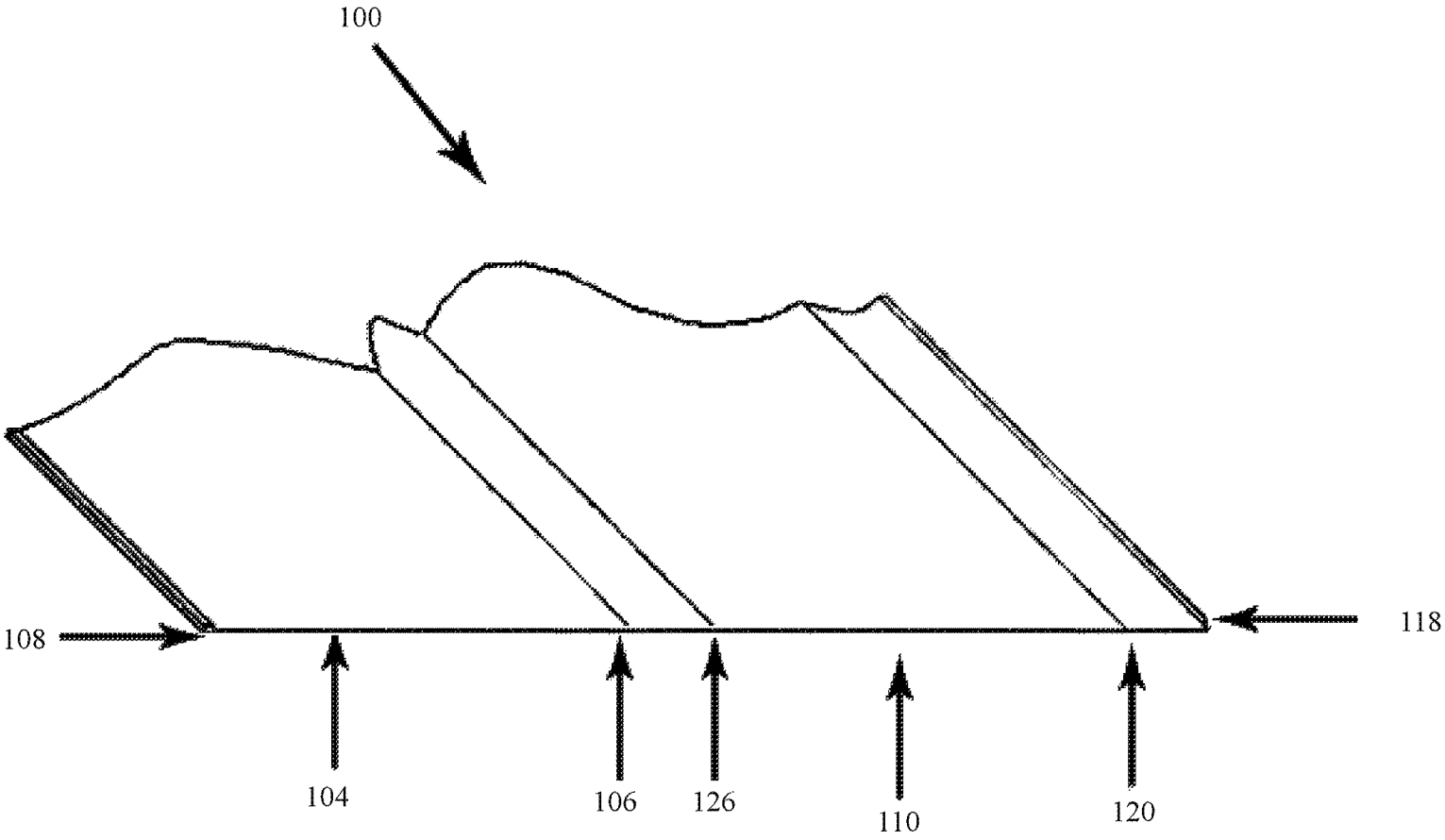
FIG. 3 illustrates a top view of the building unit encasement device, in accordance with an embodiment of the present invention.

Turning now to FIG. 3, the building unit encasement device 100 is defined by a first lateral wall 104 having a first hinge edge 106 and a first depressed edge 108. The first lateral wall 104 is generally rigid and flat. The building unit encasement device 100, which may be formed into container 102, is further defined by a second lateral wall 110 having a second hinge end and a second depressed edge 114. The first and second lateral walls 104, 110 are substantially the same and disposed in a generally parallel relationship. The first depressed edge 108 forms a cylindrical, circular depression.

It is significant to note that due to the vinyl material composition 132 of the walls 104, 110, 116, 122, the first lateral wall 104 and the second lateral wall 110 are adapted to be cut at an angle. In one embodiment, the angle is no less than 0° and no more than 359°. Vinyl is used in this embodiment because of vinyl's ability to protect against detrimental weather. However it should be understood that other similar materials can be used having similar weather resistance characteristics.

With regard to FIG. 2, container 102 is also defined by a first end wall 116 having a first protruding edge 118 and a first end wall hinge edge 120. The container 102 is further defined by a second end wall 122. The first and second end walls 116, 122 are substantially similar in size and shape and are disposed in a generally parallel relationship. Walls 116, 122 may not be fully parallel, but may have a slight angle from each other.

Figure 4:
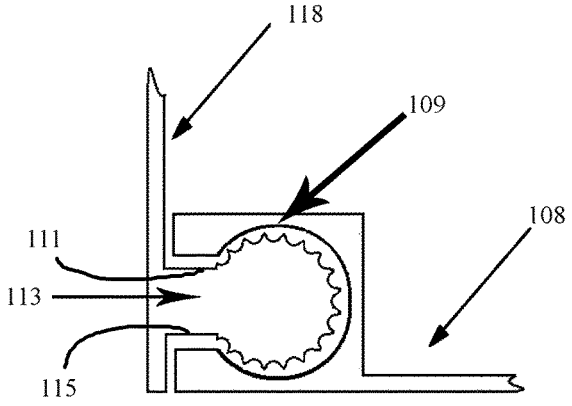
FIG. 4 illustrates a perspective view of an exemplary depressed edge of a lateral wall in conjunction with an exemplary cylindrical protrusion on a protruding edge of an end wall, in accordance with an embodiment of the present invention.

With regard to FIG. 4, the protruding edge 118 of the end walls 116 is used to enable detachable fastening of the container 102. In one embodiment, the protruding edge 118, may include a cylindrical protrusion 128 that detachably mates with the depressed edge 108 of the first lateral wall 104. Cylindrical protrusion 128 has a neck 117, which is cubical in shape, that corresponds in length and shape to a spacer portions 115 of first depressed edge 108.

The lateral and end walls 104, 110, 116, 122 join to form an elongated rectangular shape that is defined by a building unit cavity. The second hinge edge 112 of the second lateral wall 110 hingedly joins the first edge 120 of the first end wall 116. This arrangement allows the first end wall 116 to hingedly engage the first lateral wall 104. Because of the hinged relationship between the first lateral wall 104 and the first end wall 116, the cylindrical protrusion 128 detachably mates with the first depressed edge 108 of the first lateral wall 104.

Figure 5:
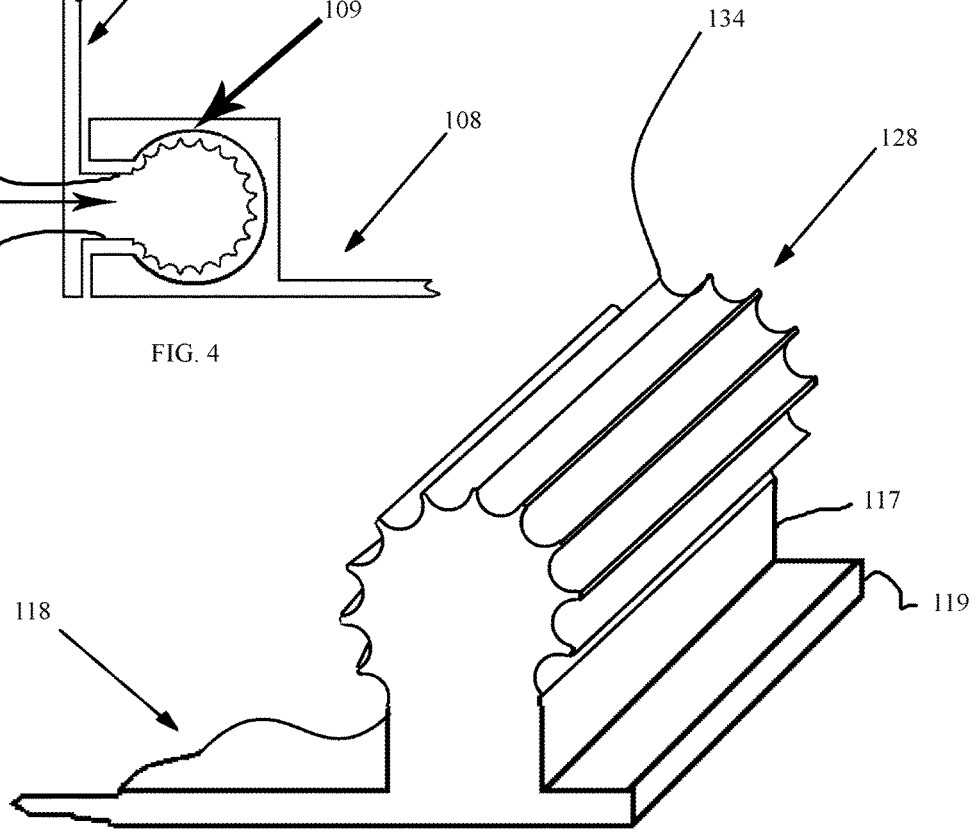
FIG. 5 illustrates a perspective view of an exemplary cylindrical protrusion on a protruding edge of an end wall having ridges compatible with a depressed edge, in accordance with an embodiment of the present invention.

As shown in FIGS. 4 and 5, a series of ribs 134 may be arranged along the cylindrical protrusion 128 to enhance the grip with the first depressed edge 108. Ribs 134 provide a ratchet grip that prevents cylindrical protrusion 128 from being removed from the depressed edge receptacle 109. Depressed edge receptacle 109 is shaped to correspond to the shape of cylindrical protrusion 128, such that cylindrical protrusion 128 has ribs that form a cylinder with a circumference that allows cylindrical protrusion to fit snugly into depressed edge receptacle 109. Depressed edge receptacle 109 has an aperture 113 that is adapted to allow insertion of a cylindrical object into a flexible material such as vinyl. Lips 111 meets aperture 113 at the upper and lower edges between depressed edge receptacle 109 and aperture 113. The present disclosure may include a plurality of ribs on the outer portion of cylindrical protrusion 128. Multiple ribs 134 enhance the grip such that if a force causes ratcheting out of a first outer set of ribs 134, the next set of ribs may maintain cylindrical protrusion 128 at least partially within depressed edge receptacle 109. Aperture 113, in one embodiment, has a width of $1/8^{th}$ of an inch, while the diameter of the cylindrical protrusion at its outermost edge of ribs 134 is $3/16^{th}$ of an inch. These dimensions are applicable to a standard 2×4 building unit. The dimensions may vary based on the size of the building unit to be enclosed by building unit encasement device 100. The dimensions of aperture 113 and cylindrical protrusion 128 are calibrated to allow easy insertion of cylindrical protrusion 128 into depressed edge receptacle 109, while preventing wind within an expected range of strength from pulling cylindrical protrusion 128 out of depressed edge receptacle 109. Ribs 134, as shown in FIG. 5, are wider at the base and narrower at the top portion. Ribs may be formed from concave grooves in the exterior portion of cylindrical protrusion 128. Ribs 134 are narrow such that they may flex as cylindrical protrusion 128 is inserted into depressed edge receptacle 109. This flexing of ribs 134 allows cylindrical protrusion 128 to more easily fit through aperture 113. In a preferred embodiment, ribs 134 are comprised of vinyl, and are formed and molded as an integral unit with all features of building unit encasement device 100, which is preferably comprised of vinyl. As shown in FIG. 4, the cylindrical inner surface of depressed edge receptacle 109 is smooth, as opposed to grooved, in order to facilitate ease of insertion of cylindrical protrusion 128 into depressed edge receptacle 109. Grooves within depressed edge receptacle 109 would create resistance during insertion of cylindrical protrusion 128, impeding the ability of a user to connect the male and female ends. In some embodiments, multiple ribs 134 are spaced apart. A gap 130 forms between the cylindrical protrusion 128 and the first depressed edge 108 of the first lateral wall 104, so as to allow for air circulation in the cavity of the container 102. An extension 119 extends from the neck 117 to the edge of the adjacent wall having the receptacle to complete the rectangular shape of container 102 and provide a smooth and consistent surface to the rectangular container 102.

Figure 6:
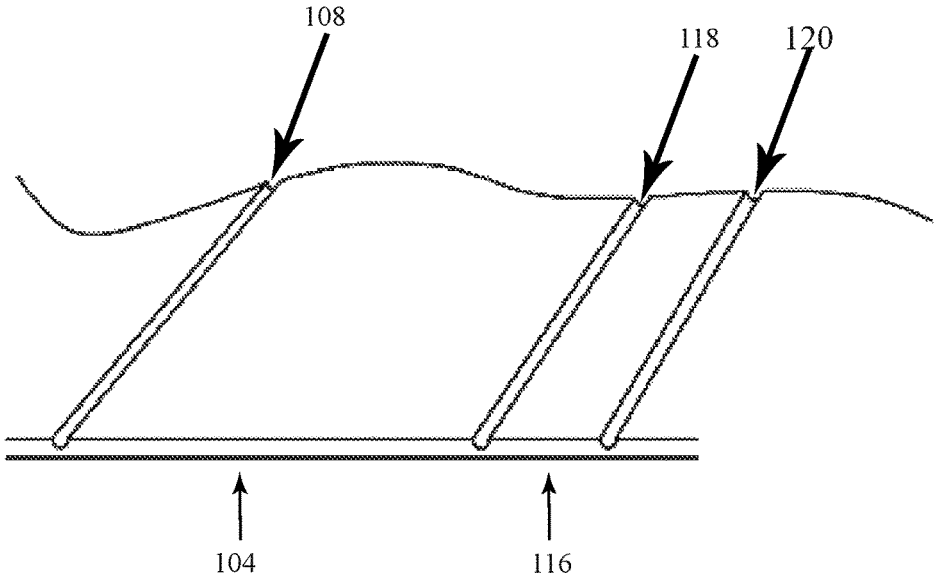
FIG. 6 illustrates a bottom view of the building unit encasement device, in accordance with an embodiment of the present invention.

With regard to FIG. 6, in one embodiment, a silicon layer coats the first lateral wall 104, the second lateral wall 110, the first end wall 116, and the second end wall 122. The silicon helps inhibit damage form insects, such as termites, carpenter ants, and carpenter bees.

Figure 7:
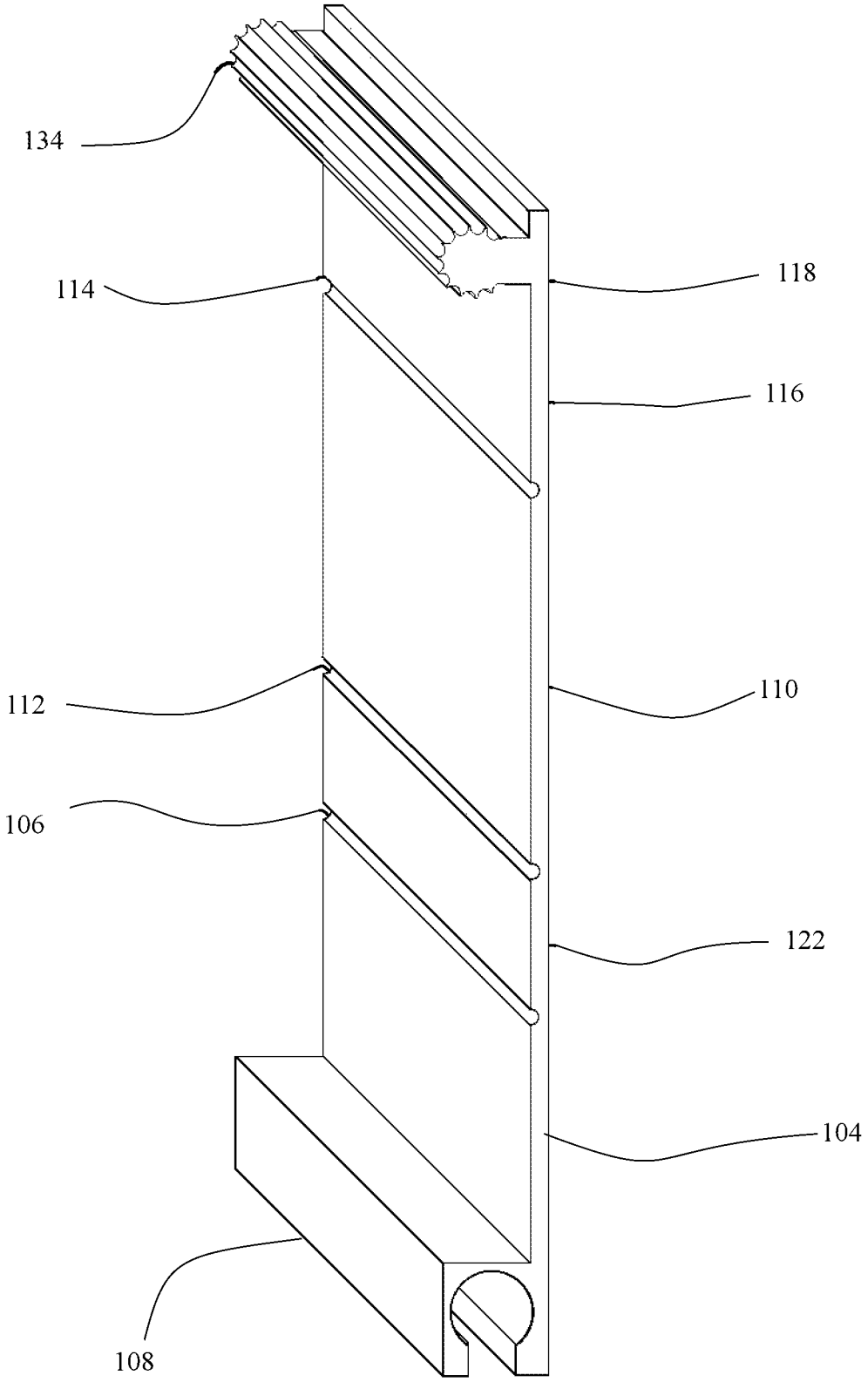
FIG. 7 illustrates a side perspective view of the building unit encasement device, in accordance with an embodiment of the present invention.

With regard to FIG. 7, first lateral wall 104 has a first depressed edge 108. First depressed edge 108 may extend longitudinally along an inner surface of lateral wall 104 such that when cylindrical protrusion 128 along edge 118 such that when closed, a flush corner is created to generate a rectangular container 102.

As will be appreciated, the present invention provides a sound and effective building unit encasement device. The invention overcomes some of the deficiencies in the prior art by protecting building units such a 2×4 strips of wood, and metal beams. It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings, shall be interpreted as illustrative and not in a limiting sense. While the invention has been described with reference to certain preferred embodiments, it will be appreciated by those skilled in the art that modifications and variations may be made without departing from the spirit and scope of the invention as defined in the appended claims.

It is also to be understood that the following claim is intended to cover all the generic and specific features of the invention herein described, and all statements of the scope of the invention that, as a matter of language, might be said to fall there between.

What is claimed is:

1. A building unit encasement device, the device comprising:

a rectangular sheet comprised of four walls;

a first lateral wall, a second lateral wall, a first end wall and a second end wall; wherein each wall has an inner surface and an outer surface, such that when the sheet is encasing a building unit, the outer surface of each wall is visible to a viewer;

a linear hinge edge at a border between each wall such that each wall is rectangular;

an elongated cylindrical protrusion extending along an inner surface of of the first end wall;

the cylindrical protrusion projecting along an axis perpendicular to a first terminal end of the sheet on the inner surface of the first end wall;

the cylindrical protrusion being configured to detachably mate with a receptacle on the inner surface the first lateral wall, the receptacle projecting along an axis perpendicular to a second terminal end of the sheet on an inner side of the first lateral wall, wherein a first side of the receptacle is in a plane perpendicular to the outer edge of the first lateral wall;

the first side of the receptacle having an opening to receive the cylindrical protrusion; the receptacle being cubicle in shape and extending along a portion of the inner surface of the first lateral wall, thereby creating a space between the first lateral wall and the building unit the space extending along a majority of the first lateral wall when the building unit encasement device is attached to the building unit the space allows a flow of air into the cavity for air circulation and drying the building unit;

the cylindrical protrusion having a spacer and a head, wherein the spacer is rectangular and the head is cylindrical, wherein the head has a diameter greater than the width of the spacer in a lateral direction on the sheet, the cylindrical protrusion being fittable into the receptacle along a connecting direction;

a plurality of ribs completely covering an outer surface of the head of the cylindrical protrusion and being substantially parallel to the connecting direction.

2. The building unit encasement device of claim 1, wherein the ribs are flexible.

3. The building unit encasement device of claim 1, wherein the ribs are comprised of vinyl.

4. The building unit encasement device of claim 1, wherein dimensions of the aperture and cylindrical protrusion are proportioned to allow easy-insertion of cylindrical protrusion into depressed edge receptacle, while preventing wind from pulling the cylindrical protrusion out of the receptacle.

5. The building unit encasement device of claim 1, wherein an aperture, has a width of approximately ⅛th of an inch, while a diameter of the cylindrical protrusion at its outermost edge of ribs is approximately 3/16th of an inch.

6. The building unit encasement device of claim 1, wherein the ratio of the width of an aperture to a diameter of the cylindrical protrusion at its outermost edge of the ribs is approximately 2 to 3.

7. The building unit encasement device of claim 1, further comprising a lip on a depressed edge of a female connection between a spacer and a cylindrical receptacle for interacting with the ribs to prevent removal of the cylindrical protrusion.

8. The building unit encasement device of claim 1, further comprising a protruding edge wall extension to create a smooth, rectangular surface for a container.

9. A method of encasing a building unit, the method comprising:

providing a sheet having an inner surface and an outer surface, further having a first lateral wall, a second lateral wall, a first end wall and a second end wall; wherein each of the walls has an inner surface and an outer surface, such that when the sheet is encasing a building unit, the outer surface of each wall is visible to a viewer;

folding the sheet around the building unit;

providing a cylindrical protrusions projecting perpendicularly from a terminal end of the inner surface of the first end wall, the cylindrical protrusion having a plurality of ribs;

guiding the cylindrical protrusion in a connecting direction to a receptacle projecting perpendicularly from a terminal end of the inner surface of the first lateral wall;

the receptacle forming a space adjacent the receptacle between the inner surface of the first lateral wall and the building unit to allow the building unit to air dry;

inserting, the cylindrical protrusion into the receptacle;

flexing the plurality of ribs during insertion into the receptacle; and forming a rectangle having a flat exterior around the building unit with the sheet.

10. The method of claim 9, further comprising providing evenly spaced ribs circumferentially around a solid core of a cylindrical protrusion.

11. The method of claim 9, wherein the ribs are comprised of a flexible material.

12. The method of claim 9, wherein the ribs are comprised of vinyl.

13. The method of claim 9, further comprising ratcheting of the cylindrical protrusion during application of wind forces to prevent removal of the cylindrical protrusion from the receptacle.

14. The method of claim 9, wherein the ribs are formed from concave grooves.

15. The method of claim 9, further comprising ratcheting the cylindrical protrusion into place within the receptacle.

16. The method of claim 9, further comprising extending a portion of the first end wall to provide a rectangular container having a smooth, continuous surface for the building unit.

17. The method of claim 9, wherein each of the ribs contacts the surface of a receptacle.

* * * * *